US005966754A

United States Patent [19]

Schuster

[11] Patent Number: 5,966,754

[45] Date of Patent: Oct. 19, 1999

[54] SLIDING DEVICE FOR TRANSPORTING PATIENTS

[75] Inventor: Jürg O. Schuster, Zumikon, Switzerland

[73] Assignee: Samarit Industries Aktiengesellschaft, Zumikon, Switzerland

[21] Appl. No.: 08/913,608

[22] PCT Filed: Mar. 1, 1996

[86] PCT No.: PCT/EP96/00876

§ 371 Date: Sep. 12, 1997

§ 102(e) Date: Sep. 12, 1997

[87] PCT Pub. No.: WO96/29971

PCT Pub. Date: Oct. 3, 1996

[30] Foreign Application Priority Data

Mar. 31, 1995 [DE] Germany ..... 195 12 008

[51] Int. Cl.[6] ..... A61G 1/00; A61G 1/013

[52] U.S. Cl. ..... 5/81.1 R; 5/81.1 C; 5/81.1 HS; 5/626; 5/625

[58] Field of Search ..... 5/81.1 R, 88.1, 5/625, 627, 706, 707, 710, 654, 655.3, 722, 81.1 C, 81.1 HS, 626

[56] References Cited

U.S. PATENT DOCUMENTS

| | | | |
|---|---|---|---|
| 2,918,681 | 12/1959 | Davis | 5/81.1 C |
| 2,984,842 | 5/1961 | Richards | 5/81.1 C |
| 4,051,565 | 10/1977 | Berge | 5/81.1 R |
| 4,067,075 | 1/1978 | Leathers et al. | 5/625 |
| 4,297,753 | 11/1981 | Langren | 5/81.1 C |
| 4,467,484 | 8/1984 | Nagatake et al. | 5/706 X |
| 4,667,355 | 5/1987 | Nishijima | 5/627 |
| 4,967,427 | 11/1990 | Cherepy | 5/81.1 C |
| 5,182,825 | 2/1993 | Stinson et al. | 5/625 |
| 5,375,277 | 12/1994 | Carr et al. | 5/625 |

*Primary Examiner*—Michael F. Trettel
*Assistant Examiner*—Fredrick Conley
*Attorney, Agent, or Firm*—Koda & Androlia

[57] ABSTRACT

A sliding device for transporting patients from a first location to a second location, with an endless band which is wrapped around a substantially board-form body. The cross-sectional circumference of the board-form body corresponds substantially to the cross-sectional circumference of the endless band. In addition, the board-form body is hollow and filled with a fluid and at least large area sides of the board-form body are flexible.

14 Claims, 2 Drawing Sheets

SLIDING DEVICE FOR TRANSPORTING PATIENTS

Figure 1A:
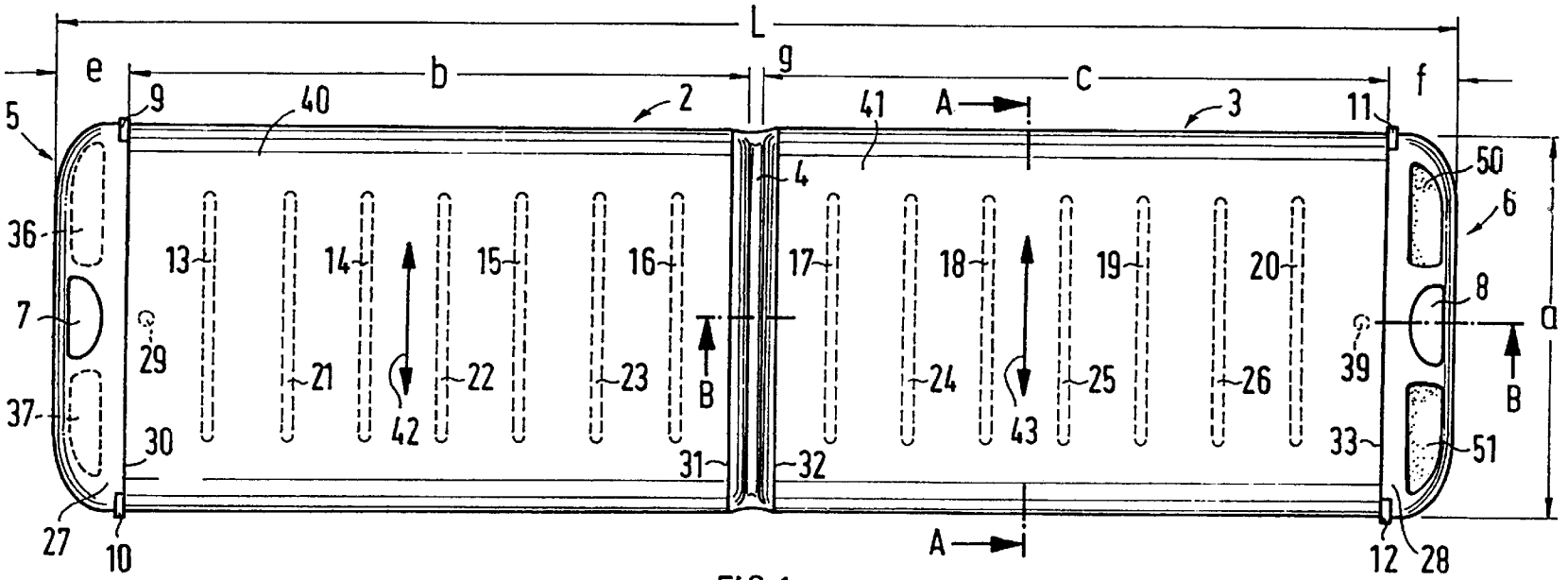

This invention relates to a sliding device according to the preamble of Patent claim 1.

The transfer of a person from a bed to another flat surface is frequently required. As a rule, the person to be transferred is a handicapped or ill person or someone not capable of walking. The mentioned transfer of persons is most often carried out in a hospital, a nursing ward or in the residence of the patient. In hospitals up to six nurses are required in order to transfer one patient from a hospital bed to a surgery table. It is not unusual for nurses to injure themselves in the process of transferring patients.

In order to facilitate the transport of a patient from a first location to a second location numerous transfer devices have already been suggested.

A transporting mat of low weight is known for example for transporting patients between a surgery table and a bed, which is designed similarly to a sleeping bag with open ends (U.S. Pat. No. 4,051,565). This transporting mat is provided on the inside with a Teflon coating, while the outside comprises a spongelike foamed material or the like. Due to the smooth inside coating the mat can be shifted easily, i.e. if the mat is grasped, for example on its top side, and pulled, the mat moves similarly to tank tractor treads. Of disadvantage in this mat is however that its shape is not stable and for this reason can readily sink into depressions in the bed or the like.

In another known patient transfer device, a rigid frame is provided with roller cylinders wherein about this frame an endless cloth is wound (U.S. Pat. No. 2,918,681). Compared to the previously described mat, this device differs thereby that the insides of the endless cloth are not disposed such that they are superjacent but rather are disposed on the roller cylinders. This ensures better stability. Apart from the fact that the patient feels the hard roller cylinders in the back if the endless cloth is not sufficiently thick, however, the rigid frame with the roller cylinders is very cost-intensive.

An endless sliding mat is also used in another patient transfer device (U.S. Pat. No. 3,769,642, FIG. 8, Pos. 15). Herein two tension bands are attached on the endless sliding mat, whose width corresponds approximately to the width of the sliding mat. The endless tension band has on its inside a lower coefficient of friction than on its outside; to this extent it corresponds to the already described transporting mat according to U.S. Pat. No. 4,051,565.

A patient transporting device is furthermore known which comprises flexible yet strong and light materials (U.S. Pat. No. 4,700,416). This transporting device comprises a central region and two wing regions which are secured on the central region and which can be folded over. However, the transporting device can only with effort be moved slidingly over a surface.

In another known patient transporting mat the sliding shift is also not possible using low forces (U.S. Pat. No. 4,744,115). This mat comprises substantially two portions which can be folded one over the other.

A sliding device according to the species, which can be produced significantly more cost-effectively than the sliding mat according to U.S. Pat. No. 2,918,689 since it does not include expensive rollers, is known from DE-C-3 806 470. This sliding device also comprises an endless band which is however wrapped about a rigid board, wherein the frictional resistance between the endless band and the rigid board is so low that it can be overcome by an operator pulling on the endless band if a person is located on the endless band.

A further sliding device according to the species, with two portions which can be folded one on top of the other, is known from DE 88 16 024 U1.

Another known patient transfer device comprises an elongated endless band which is enclosed all around and comprises in its interior a sliding medium, for example, a liquid lubricant or air (U.S. Pat. No. 5,005,232=EP-A-0 469 767). But in this device there is also the disadvantage that its spatial stability is insufficient.

Lastly is also known a stretcher for patients which is elongated, flexible and inflatable (GB-A-2 261 605, EP-A-0 162 785). This stretcher has approximately the form of an inflatable mattress and is provided with side handles. The outside of the stretcher is said to be smooth such that it can readily be shifted. Of disadvantage is herein, however, that the stretcher is relatively large and does not have a smooth surface but rather is divided into several tubular elements.

The invention is based on the task of creating a sliding device for transporting patients which is simple to manufacture and operate.

This task is solved according to the characteristics of Patent claim 1.

The advantage realized with the invention comprises in particular that the sliding properties of the device are as good as those of the sliding device according to DE-C-3 806 470 and that, moreover, the bearing properties can be adapted to the particular situation by changing the air pressure.

Figure 1B:
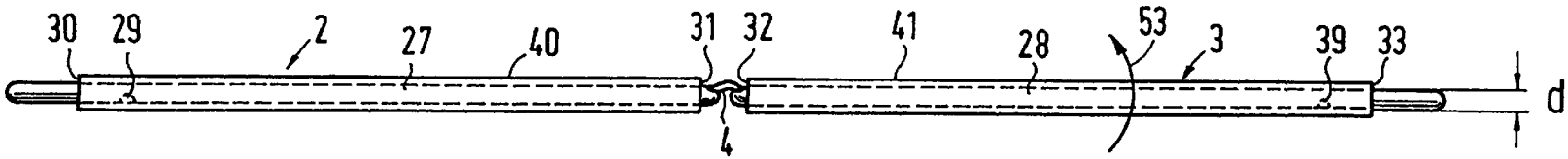

An embodiment example of the invention is depicted in the drawing and will be described in the following in further detail. In the drawing show:

FIG. 1*a* a top view onto the sliding device according to the invention;

FIG. 1*b* a side view of the sliding device according to FIG. 1*a;*

Figure 2A:
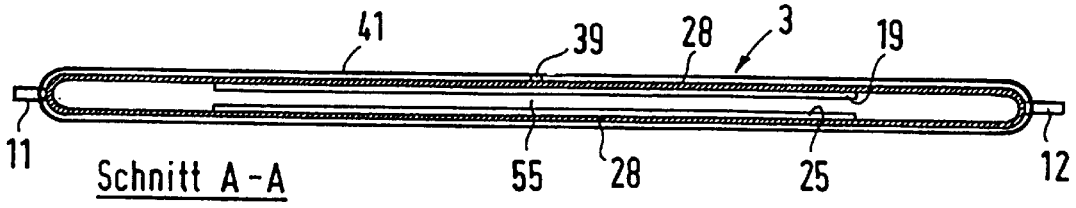
Figure 2B:
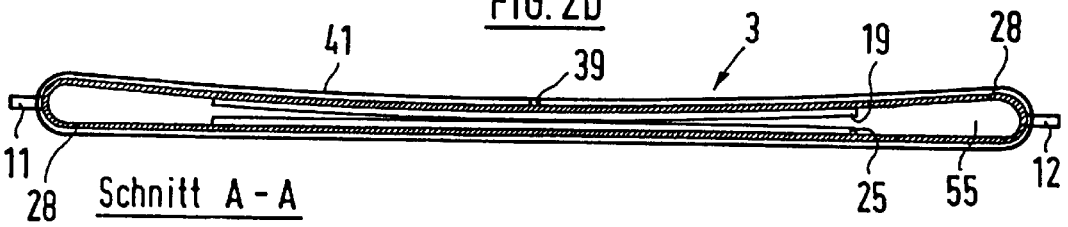
Figure 2C:
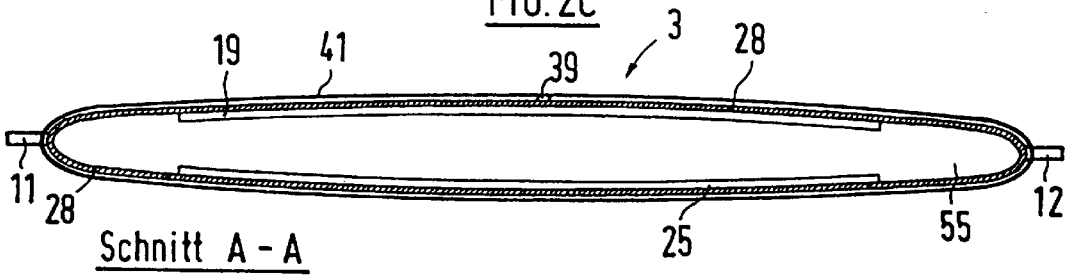
Figure 2D:
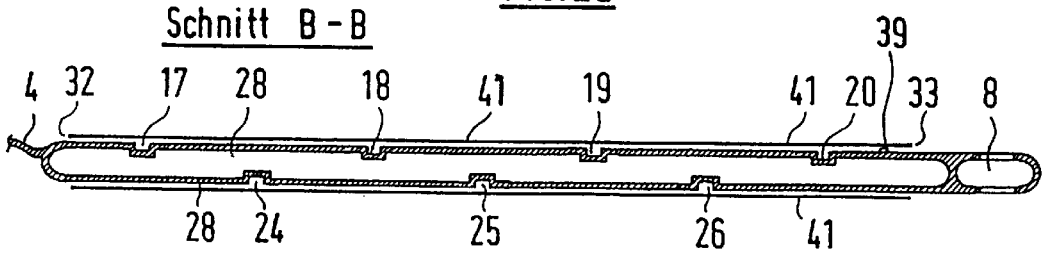

FIG. 2*a* a cross section A—A through the right portion of the device according to FIG. 1;

FIG. 2*b* a section A—A as in FIG. 2*a,* however with pushed-in upper side of the sliding device;

FIG. 2*c* a section A—A as in FIG. 2*a,* however with inflated upper side of the sliding device;

FIG. 2*d* a section B—B through the device according to FIG. 1.

In FIG. 1*a* is shown a top view onto a sliding device 1 according to the invention. It is evident that the sliding device 1 is constructed of two pieces and comprises one half 2 and one half 3. Both halves 2, 3 are connected via a hinge 4. Parts 2, 3 comprise endless bands 40, 41 which are each wrapped about a relatively firm, air-filled, inner portion 27, 28. The side edges of these endless bands are denoted by 30, 31 or 32, 33, respectively. By 29, 39 are denoted valves through which air can be let in or out into/from portions 27, 28. The free ends 5, 6 of these firm inner portions 27, 28 can be seen on the left or right respectively, side of the sliding device 1. The end 5 comprises on its underside two recesses 36, 37, while end 6 comprises such recesses 50, 51 on its upper side. The recesses serve, for example, for receiving stick-on labels on which the manufacturer is listed and/or short instructions for use are specified.

The relatively firm inner portions 27, 28 are preferably synthetic material portions at whose ends 5, 6 are disposed cutouts 7, 8 which serve as grips. These synthetic material portions 27, 28 comprise stops 9, 10; 11, 12 which can be pressed toward the inside or can be folded over. This makes possible, on the one hand, that the endless band or cloth 40, 41 cannot slide away laterally during the use of the sliding device 1 and, on the other hand, can be placed onto the firm inner portion 27, 28 when the stop 9 to 11 is slid in.

The firm inner portion 27, 28 comprises on its upper side, as well as also on its underside, ribs which serve for stiffening. The ribs directed inwardly are denoted in FIG. 1*a* by 13 to 20 or 21 to 26, respectively.

The length of one half 2, 3 is denoted by b or c, respectively, the width by a. Values customary in practice are herein b=c=80 cm; a=50 cm. The total length L of the device 1 is approximately 180 cm so that for the width of ends 5, 6 values of e, f=9 cm are obtained. The hinge 4 has approximately a width of g=2 cm. The double arrows 42, 43 indicate the direction in which the endless bands 40, 41 can be moved.

In FIG. 1*b* the two firm inner portions 27, 28 with the endless bands 40, 41 encompassing them are depicted again. In practice, the height d of these portions 27, 28 is approximately 20 to 24 mm. On the relatively firm, air-filled portions 27, 28 are provided valves 29, 39 which are suitable for the inlet or outlet of air. The hinge 4 is implemented so as to be flexible and connects the upper edges of portions 27, 28 such that these can only be folded together in this direction. This direction is indicated by an arrow 53.

In FIG. 2*a* is shown a cross section A—A through the right half 3 of device 1.

Herein can be seen the inner firm but hollow portion 28 which is provided with holding clips 11, 12. About this portion 28 the endless band 41 is wrapped, whose underside forms with the upper side of portion 28 a very low coefficient of friction. A hollow volume denoted by 55 can be inflated via valve 39. By 19, 25 are denoted two stiffening ribs visible in the sectional representation according to FIG. 2*a*.

FIG. 2*b* shows the same device as FIG. 2*a*. However, in volume 55 a lower air pressure obtains than in the device according to FIG. 2*a*.

FIG. 2*c* shows also the same device as FIG. 2*a*, wherein, however the air pressure is higher than in the representation of FIGS. 2*a* and 2*b*.

In FIG. 2*d* a section B—B through the right half 3 is shown. The sectioned stiffening ribs 17 to 20 and 24 to 26 can be seen, which are directed toward the inside. In addition, the handle cutout 8 on the right side can be seen. In the representation of FIG. 2*d* the movement of the endless band takes place into the plane of drawing.

Device 1 is sold in the folded state in a box or the like. In the folded state, half 3 is folded in the direction of arrow 53 and is disposed on top of half 2.

The folded state is also the state in which it is carried. Since herein the two handle cutouts 7, 8 are one superjacent to the other, the entire device 1 can be readily transported in one hand.

For the transporting or the location change of a patient, the device 1 is folded open such that it assumes the form depicted in FIGS. 1, 2. The patient subsequently lies down on the device. The patient can now be moved thereby that, for example, the endless bands 40, 41 or one of the ends 5, 6 is pulled in the direction of arrows 42, 43. Since the coefficient of friction between the inside of an endless band 40, 41 and a firm portion 27, 28 is extremely small, low forces suffice in order to transfer even a heavy patient.

By inflating portions 27, 28 the halves 2, 3 can be adapted to patients of different weight. The stiffening ribs 13 to 26 serve for the purpose of lending stability to portions 27, 28 such that, for example, they cannot be inflated like balloons since extreme curvatures are not required in practice.

I claim:

1. Sliding device for transporting patients from a first location to a second location, with an endless band which is wrapped about a substantially board-form body, wherein the cross sectional circumference of the board corresponds substantially to the cross sectional circumference of the endless band, characterized in that the substantially board-form body (27, 28) is hollow and filled with a fluid and that at least large-area sides of the board-form body (27, 28) are flexible.

2. Sliding device as claimed in claim 1, characterized in that the board-form body comprises an opening (29, 39) through which fluid can be introduced.

3. Sliding device as claimed in claim 1, characterized in that the fluid is air.

4. Sliding device as claimed in claim 1, characterized in that the board-form body (27, 28) is composed of two halves connected via a hinge (4) such that the one half (28) can be folded onto the other half (27).

5. Sliding device as claimed in claim 1, characterized in that the hollow board-form body (27, 28) comprises synthetic material and has a very smooth surface.

6. Sliding device as claimed in claim 4, characterized in that the hinge (4) is implemented such that it is flexible and connects only an upper edge of the two halves (27, 28).

7. Sliding device as claimed in claim 1, characterized in that said board-form body comprises two hollow bodies (27, 28) made from synthetic material and provided stiffening ribs (13 to 26).

8. Sliding device as claimed in claim 7, characterized in that the stiffening ribs (13 to 26) are provided on an upper side as well as also on an underside of the two hollow bodies (27, 28).

9. Sliding device as claimed in claim 8, characterized in that the stiffening ribs (13 to 26) are directed inwardly.

10. Sliding device as claimed in claim 4, characterized in that at the free ends (5, 6) of the two halves (2, 3) handle troughs (7, 8) are provided.

11. Sliding device as claimed in claim 4, characterized in that at the free ends (5, 6) of the two halves (2, 3) recesses (50, 51; 36, 33) are provided for receiving stick-on labels.

12. Sliding device as claimed in claim 1, characterized in that stops (9, 10, 11, 12) are provided which prevent the endless bands (40, 41) from sliding.

13. Sliding device as claimed in claim 12, characterized in that the stops (9, 10, 11, 12) can be folded over or slid in such that the endless bands (40, 41) can be slid over the firm hollow synthetic portions (27, 28).

14. Sliding device as claimed in claim 1, characterized in that the board-form hollow body is comprised of synthetic material and is manufactured in rotational molding.

* * * * *